United States Patent [19]

Lovisa et al.

[11] 3,933,332

[45] Jan. 20, 1976

[54] SELF-SEALING TIE ASSEMBLY FOR ERECTING CONCRETE FORMS

[75] Inventors: Peter R. Lovisa, Pelham; Dusan Tausanovitch, Northport, both of N.Y.

[73] Assignee: Tullio E. Lovisa, Huntington, N.Y. ; a part interest

[22] Filed: May 17, 1974

[21] Appl. No.: 470,923

Related U.S. Application Data

[63] Continuation-in-part of Ser. No. 433,085, Jan. 14, 1974, abandoned.

[52] U.S. Cl. ..... 249/42; 249/43; 249/217

[51] Int. Cl.[2] ..... E04G 17/08

[58] Field of Search ..... 249/40–46, 249/190–191, 213–214, 216–217, 219 W

[56] References Cited

UNITED STATES PATENTS

| | | | |
|---|---|---|---|
| 1,991,256 | 2/1935 | Muntz | 249/43 |
| 2,001,052 | 5/1935 | Colt | 249/217 |
| 2,099,260 | 11/1937 | Colt | 249/43 |
| 2,314,866 | 3/1943 | Bosco | 249/20 |
| 2,709,292 | 5/1955 | Otti | 249/43 |
| 3,405,904 | 10/1968 | Williams | 249/40 |
| 3,437,309 | 4/1969 | Tausanovitch | 249/43 |
| 3,667,720 | 6/1972 | Williams | 249/42 |

*Primary Examiner*—J. Howard Flint, Jr.
*Assistant Examiner*—John McQuade
*Attorney, Agent, or Firm*—Kane, Dalsimer, Kane, Sullivan and Kurucz

[57] ABSTRACT

A feed-through, self-sealing tie assembly for mounting as a unit on concrete forms and capable of being removed therefrom without disassembling the forms or the tie assembly is disclosed. The tie assembly includes an elongated tie rod on which is mounted an elongatable, elastomeric sleeve. The sleeve and the tie rod have interengageable surfaces for releasably coupling the sleeve to the tie rod. Guide means positioned over one end of the sleeve facilitates insertion of the tie assembly through corresponding spaced openings in the forms so that both ends of the sleeve are projected exteriorly of the forms. The openings are sealed by the elastomeric sleeve due to the lateral deformation of the sleeve when in the form openings and by the compressive forces exerted by the concrete on the tie assembly. Thus, the elastomeric sleeve provides a self-sealing and removable closure. Wedges or nuts cooperate in coupling the tie rod to the forms; and external spreader brackets are provided to maintain the forms apart the prescribed distance.

25 Claims, 9 Drawing Figures

SELF-SEALING TIE ASSEMBLY FOR ERECTING CONCRETE FORMS

REFERENCE TO RELATED APPLICATIONS

This application is a continuation-in-part of application Ser. No. 433,085, filed Jan. 14, 1974, now abandoned and it relates to an external spreader system forming part of a tie assembly of the type disclosed in related application U.S. Ser. No. 232,450, filed on Mar. 7, 1972 now U.S. Pat. No. 3,822,860.

BACKGROUND OF THE DISCLOSURE

This invention relates to an improved tie assembly for use in concrete forming operations and permits installation of the tie assembly as a unit while, at the same time, sealing the holes in the forms through which the tie is inserted.

Many types and designs of concrete tie assemblies have been disclosed and are in use for erecting forms prior to pouring the concrete therebetween. A tie which is generally used where lighter concrete pressures are encountered is the continuous single tie rod which is formed having two weakened break points at spaced distances from the face of the concrete so that after the forms are removed that portion of tie extending from the break point to the exterior of the concrete face can be removed. Another type of tie generally employed is a reusable tapered tie which can be removed from the concrete wall in the direction of the larger diameter portion of the tapered rod. This type of rod requires a coating before each use and must be hammered or rotated or both to be removed from the concrete after the forms have been removed. Still another tie that is employed is an integral disconnecting tie which consists of a threaded innerpart which is lost and cannot be reused after the concrete is poured. Only the threaded bolts or outer parts which can be removed from the inner part remain for reuse. Also, with the conventional push through tie assembly the metal parts or other portions are of larger diameter than the holes through the forms thereby permitting grout leakage.

A tie assembly which is exemplary of the prior art in which the entire assembly can be reused is disclosed in U.S. Pat. No. 3,437,309. The tie assembly is provided with a yieldable tube and a tie rod slidably disposed therein, the tube being employed as the sleeve means between the forms. After the forms have been removed the entire assembly including the tie rod is removed from the concrete forms.

Another type of tie rod assembly is disclosed in U.S. Pat. No. 2,314,886 which in one embodiment sets forth an internal spreader system for a tie rod assembly and in another embodiment describes the tie rod which extends through a tubular member slidably mounted thereon in which the tubular member extends through the form faces so as to project substantially from the finished work. The tie rod is removed prior to removing the forms and thereafter the tubular member which is formed of a flexible material is removed from the concrete by grasping the protruding end thereof.

SUMMARY OF THE INVENTION

The present invention provides a unique tie assembly having an external spreader system and which can be installed on concrete forms as a unit in a single operation and can be removed from the concrete and the concrete forms as a unit prior to stripping the forms from the concrete structure thereby eliminating substantial labor cost for erecting the forms to receive the concrete and stripping the forms therefrom after the concrete is formed.

Another object of the invention is to provide an improved tie assembly having an external spreader system in which the tie can be mounted on the concrete forms as a unit in a single operation in which concrete discoloration due to seepage is eliminated by watertight connection between the form opening and the novel tie assembly of the present invention.

Another object of the invention is to provide an elongatable replaceable elastomeric sleeve which, when mounted through corresponding or opposed spaced openings in the concrete forms, both ends of the sleeve are projected exteriorly of the forms whereby the openings are sealed by the elastomeric sleeve due to the lateral deformation of the sleeve when in the openings by the compressive forces exerted by the concrete on the tie assembly to provide a self-sealing removable closure by the elastomeric sleeve.

According to one aspect of the invention herein, a feed through, a self-sealing tie assembly is provided for mounting as a unit on concrete forms and capable of being removed therefrom without first disassembling the forms or tie assembly. The improved tie assembly comprises an elongated tie rod having means disposed at each end thereof for releasably mounting the tie rod in fixed position on the cement forms and means are also provided on the tie rod between the ends thereof for mounting an external spreader means to releasably hold the concrete forms a predetermined distance apart. An elongatable elastomeric sleeve is positioned between the ends of the tie rod. The sleeve and the tie rod are provided with interengageable surfaces for releasably coupling the sleeve to the tie rod in order that the sleeve may be replaced when worn or damaged. Also, the sleeve includes a guide means positioned over one end thereof to facilitate the insertion of the assembly through corresponding spaced openings in the forms so that both ends of the sleeve are projected exteriorly of the forms whereby the openings are sealed by the elastomeric sleeve due to the lateral deformation of the sleeve when in the openings by the compressive forces exerted by the concrete on the tie assembly to provide a self-sealing removable closure by the elastomeric sleeve.

DESCRIPTION OF THE PREFERRED EMBODIMENT

Figure 1:
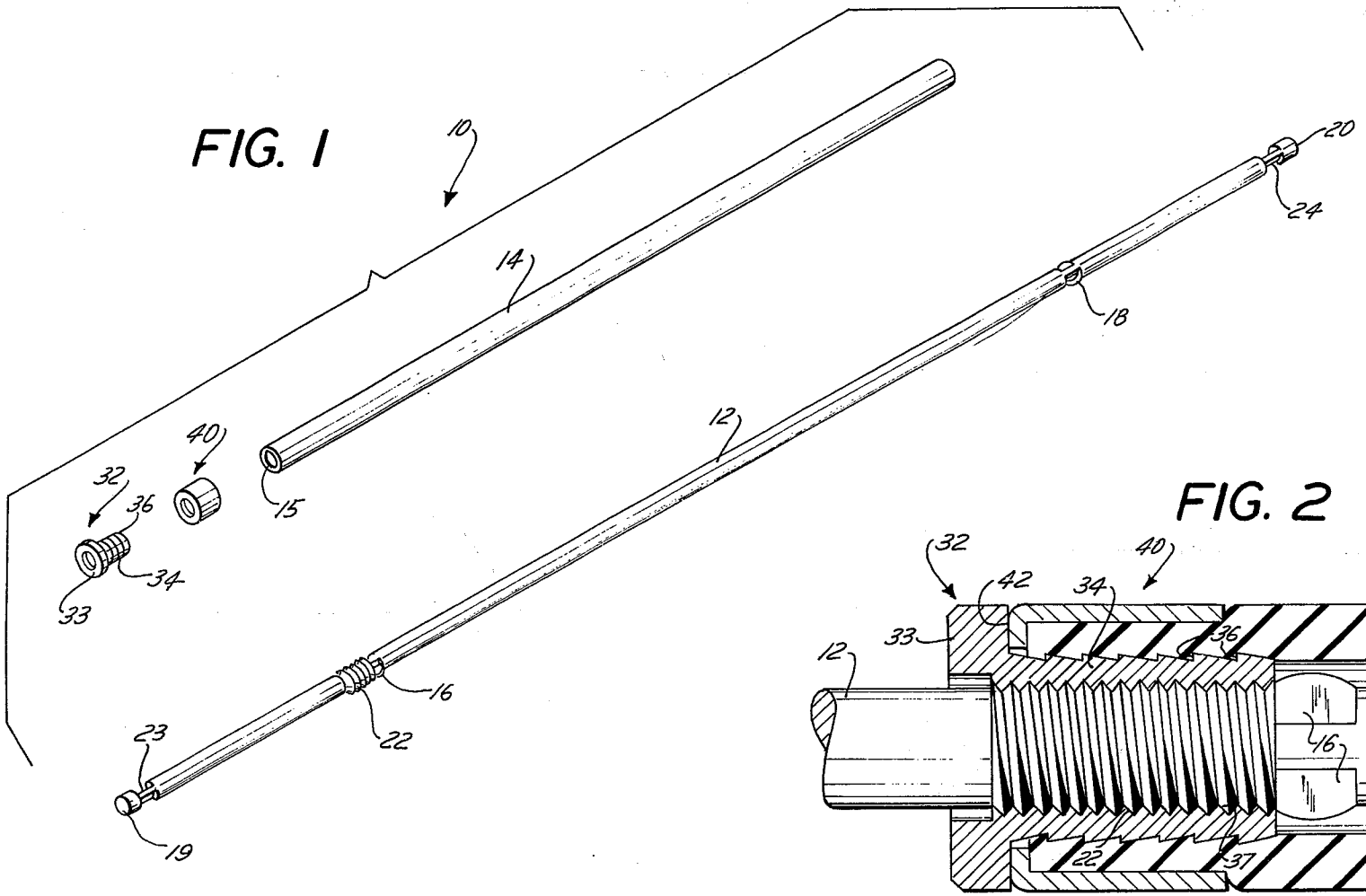
FIG. 1 is an exploded view of the tie assembly which illustrates one form of the invention herein.

For a better understanding of the invention reference is had to the drawings and particularly to the embodiment of FIGS. 1 through 6.

Tie assembly 10 includes an elongatable elastomeric sleeve 14 and tie rod 12. Tie rod 12 is made of metal preferably a suitable steel which is capable of withstanding forces exerted by the concrete when poured between forms F. The rod may be hardened throughout or at selected zones such as at the ends bearing notches 23 and 24. Stops 16 and 18 are spaced a predetermined distance apart and are positioned a set distance from ends 19 and 20 of rod 12. Stops 16 and 18 form part of the external spreader means or system for spacing and maintaining the forms F a given distance apart. Upset threads 22 are formed on rod 12 for advantageously cooperating in permitting the sleeve to be replaced when worn or damaged; and the threads terminate at stop 16 to prevent sleeve 14 from passing beyond stop 16. Stops 16 and 18 are conveniently formed on rod 12 by a swaging operation which forms diametrically opposed raised projections or stops 16 and 18.

Figure 2:
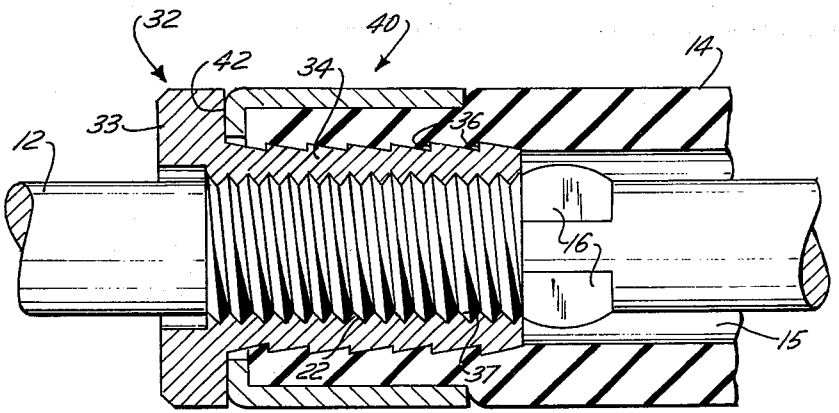
FIG. 2 is an elevational view of the tie rod and elastomeric sleeve broken away and showing an end of the elastomeric sleeve and guide means mounted on the tie rod.

Adjacent ends 19 and 20 are a pair of parallel notches 23 and 24. These notches form part of the locking assembly for removably mounting the tie rod assembly to forms F. The locking assembly is described in our copending patent application Ser. No. 232,450, filed Mar. 7, 1972 for "Reusable Tie Assembly For Concrete Forms." The wedge means 30 and the manner in which it is mounted on tie rod 12 in parallel slots 23 and 24 is also described. Elastomeric sleeve 14 is made of a deformable stretchable rubber-like material and is preferably made of natural rubber although synthetic rubbers may be used. A preferred sleeve is made of EPBM tubing sold by the Elmhurst Rubber Company. Elongatable elastomeric sleeve 14 is removably mounted on rod 12 and has mounted at one end thereof threaded coupling 32. Threaded coupling 32 is formed having a flanged head 33 and a depending skirt 34 having a series of concentric ridges 36 to frictionally engage sleeve 14 in passage 15 as illustrated in FIG. 2. Threaded coupling 32 is preferably made of a hardened steel which is readily machined. Threaded coupling 32 has internal threads 37 for threadedly engaging upset threads 22 on rod 12 thereby providing interengageable surfaces between the elastomeric sleeve 14 and rod 12 while at the same time permitting the sleeve to be replaced when worn or damaged.

Guide means 40 is provided for mounting over one end of sleeve 14 as illustrated in FIG. 2 and is generally formed from a malleable material, such as brass, which can be easily crimped. It is in the form of a tube, one end being a collar 42 of reduced diameter slightly less than the diameter of flanged head 33 of threaded coupling 32 so that when guide means 40 is mounted on elastomeric sleeve 14 the inner surface of flanged head 33 will bias against the inwardly depending collar 42 as shown in FIG. 2. Guide means 40 is held in fixed position on the elastomeric sleeve by a crimping operation so as to compress the walls of the elastomeric sleeve thereby adding a compressive force against the concentric ridges 36 so that threaded coupling 32 will remain frictionally engaged within the end of the elastomeric sleeve 14. It should be noted that the diameter of flanged head 33 of threaded coupling 32 is smaller than the outside diameter of guide means 40 so that the guide means 40 will facilitate insertion of the elastomeric sleeve through corresponding openings 44, 45 in forms F without the forward face of flanged head 33 contacting the opening.

Figure 3:
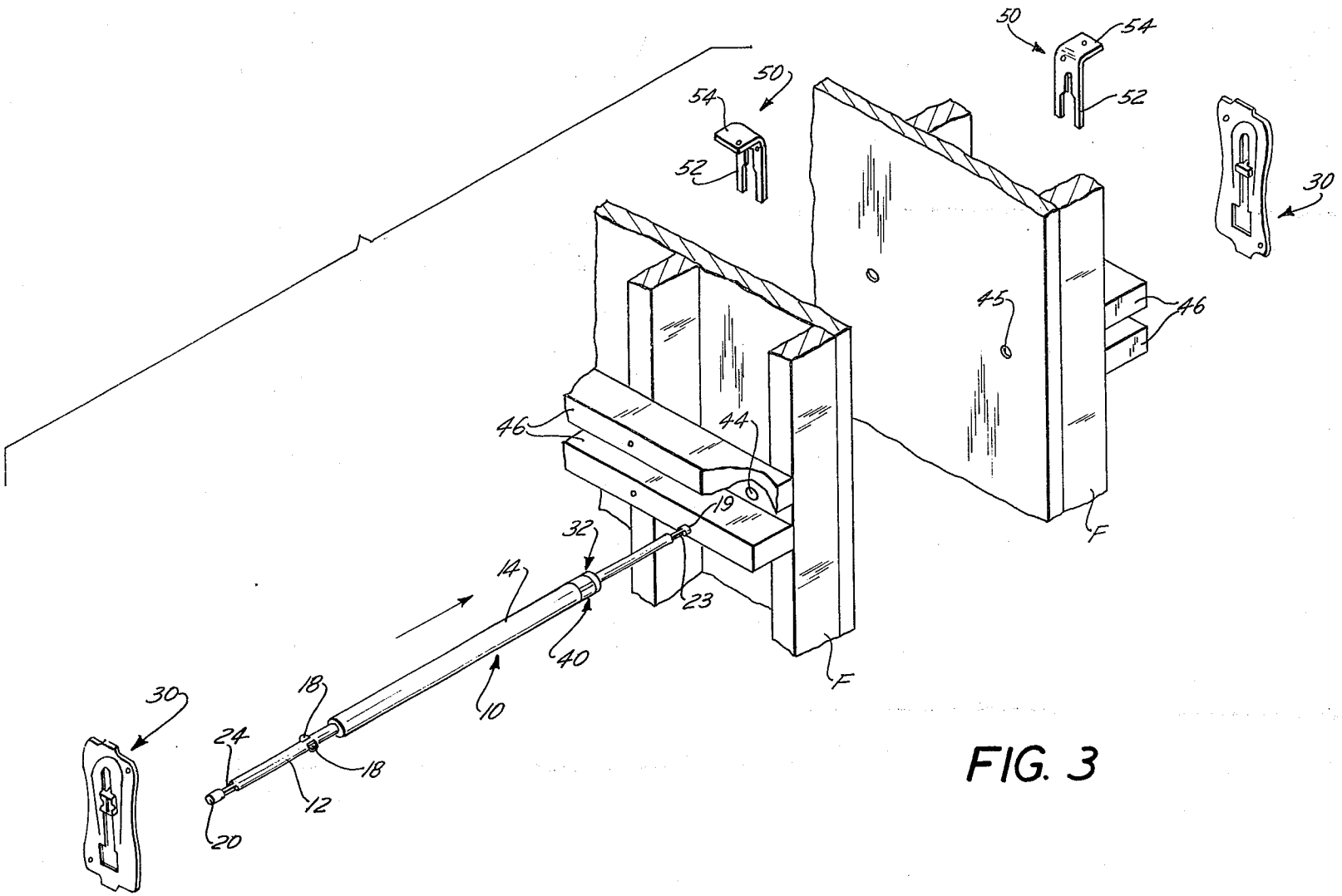
FIG. 3 is an exploded view of the tie assembly prior to mounting on the concrete forms.
Figures 4, 5:
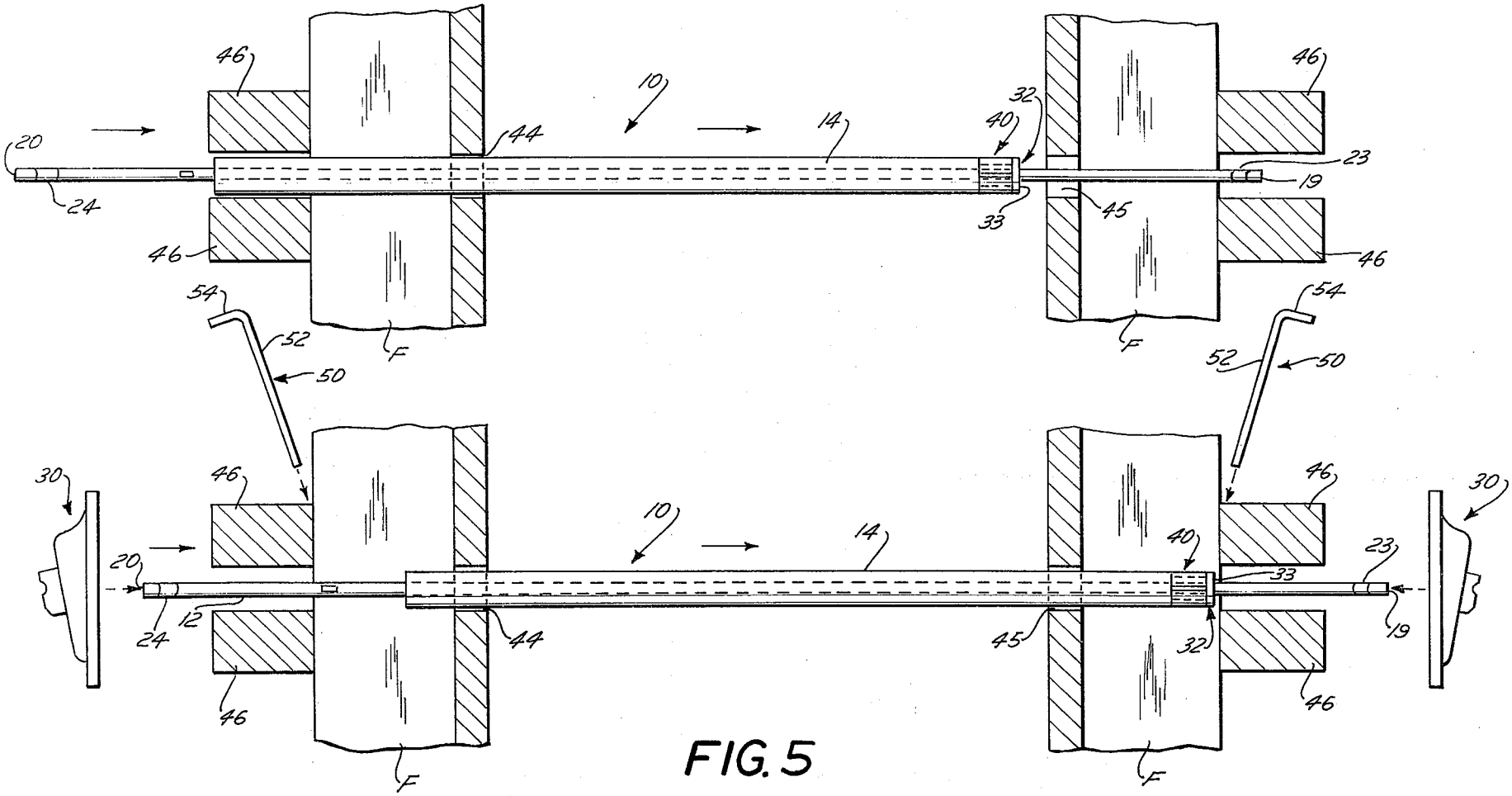
FIG. 4 is an elevational view partly in section showing insertion of the tie assembly through corresponding spaced openings in the concrete forms.
FIG. 5 is an elevational view of the assembly in which the external spreader means and wedge for anchoring the tie rod assembly in place is illustrated being positioned on the tie assembly.

In FIG. 3 there is depicted an exploded view of the tie assembly being mounted in position on forms F. The assembly 10 is inserted through corresponding openings 44 and 45 in forms F with guide means 40 mounted on elastomeric sleeve 14 being the first portion of elastomeric sleeve 14 to pass through opening 44. Thereafter, tie assembly 10 is pushed through opening 45 as illustrated in FIG. 4 so that guide means 40 stops just short of the horizontally extending members 46 identified as walers. As tie assembly 10 is being inserted through openings 44 and 45 of forms F, elastomeric sleeve 14 is held firmly on tie rod 12 by threaded coupling 32. When the tie assembly 10 is in place it is fixed on the forms F placed by wedge means 30 in parallel slots 22 and 23 as depicted in FIG. 5. Parallel slots 22 and 23 are formed with an arcuate wall portion as seen in FIGS. 4 and 5 so that when wedge means 30 is mounted therein the bearing load of the tie extends axially through the tie rod 12 and prevents the tie rod from bending due to the forces exerted by wedge means 30 when mounted in place.

Figure 6:
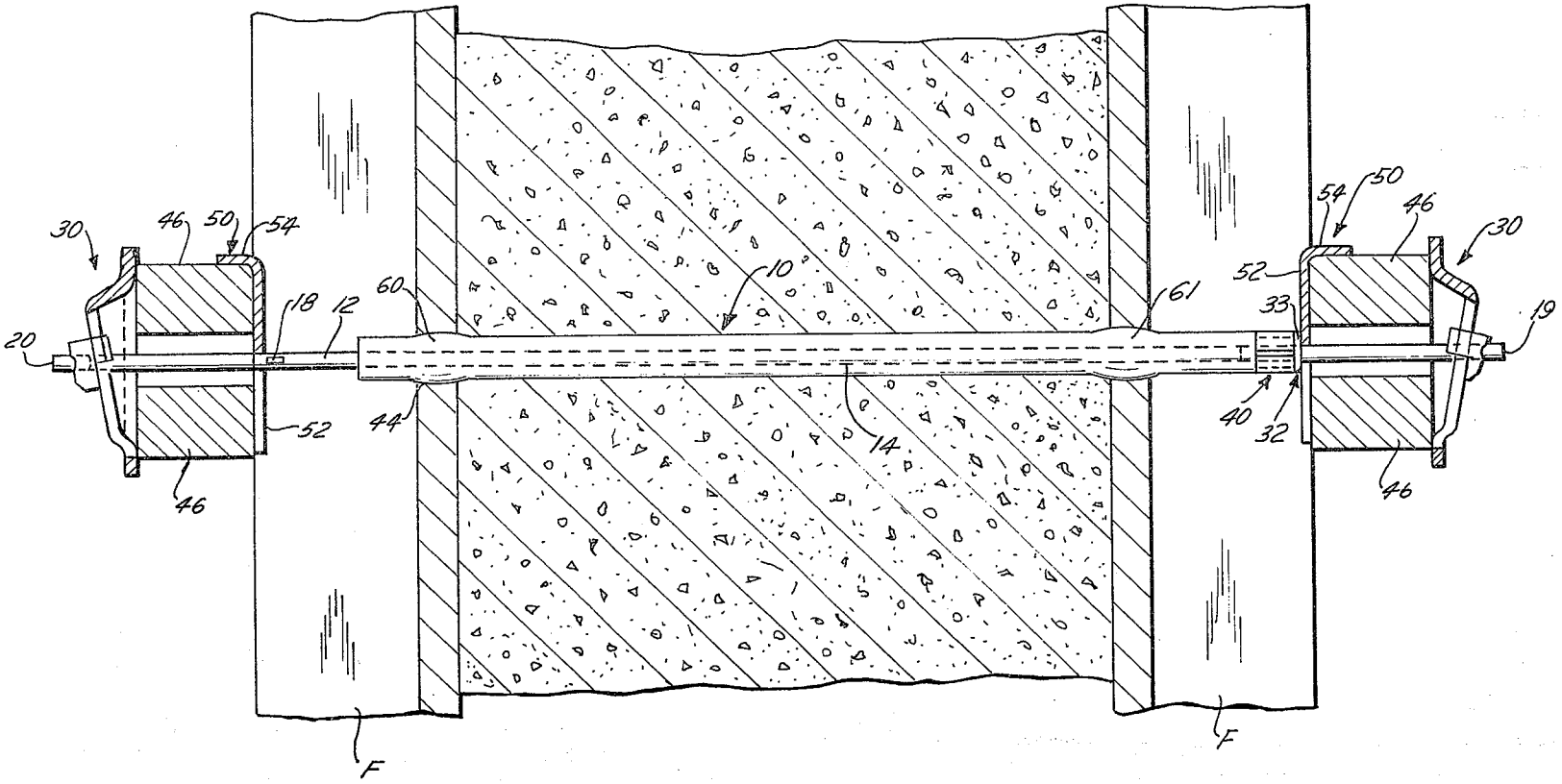
FIG. 6 is an elevational view in section of the tie assembly mounted in place after the concrete has been poured between the concrete forms.

External spreader brackets 50 cooperate in maintaining the forms in the selected spaced apart relationship and are made of metal formed in the shape of an L. Vertical leg 52 is slotted so that it will slip over stop 18 on tie rod 12. Horizontal leg 54 is mounted on waler as illustred in FIG. 5. One of the spreader brackets 50 slips over tie rod 12 in front of threaded coupling 32 as shown in FIG. 6. When the spreader brackets are in place the forms F are fixed a predetermined distance apart so that the forms will not be displaced due to the loads of poured concrete.

In FIG. 6 tie assembly 10 is illustrated mounted in fixed position on forms F with wedge means 30 and spreader bracket 50 mounted in fixed position. Due to the compressive forces exerted by the concrete on tie assembly 10, the elastomeric sleeve is squeezed and is laterally deformed towards the ends of the sleeve. The sleeve forms a bubble 60, 61 which tightly fills the holes 44 and 45. The bubble forms a seal so that the concrete when it is still in a fluid state does not leak through openings 44 and 45 of forms F.

To remove tie assembly 10 after the concrete has hardened, the tie assembly is dismantled by removing wedge means 30 from the ends of tie rod 12 by simply using a blow of a hammer in an upward direction. External spreader bracket 50 is removed by hitting the bottom of the bracket with a hammer and forcing the bracket in an upward position. Thereafter, the entire tie assembly is removed from the concrete by simply pulling or pushing the tie assembly in the direction of the arrow illustrated in FIG. 5. Thus, the guide means 40 mounted on elastomeric sleeve 14 will be the lead end of the tie assembly as it is removed from the concrete, with end 20 of the tie rod being the last portion of the tie assembly to clear forms F through opening 45. The tie assembly is removed as a unit and the forms F are ready to be stripped from the concrete in the conventional manner. The elastomeric sleeve 14 is removed from the concrete even though the concrete exerts a compressive force on the elastomeric tube. The force exerted on the tie assembly axially in the direction indicated by the arrow of FIG. 5 causes elastomeric sleeve 14 to elongate and thereby break the bond of the concrete against the sleeve and allow the sleeve to be removed from the concrete without additional effort. Also, no portions of the assembly remain in the concrete to cause problems with respect to bleeding through or discoloration and the entire tie assembly is ready for use in a similar operation.

Figure 7:
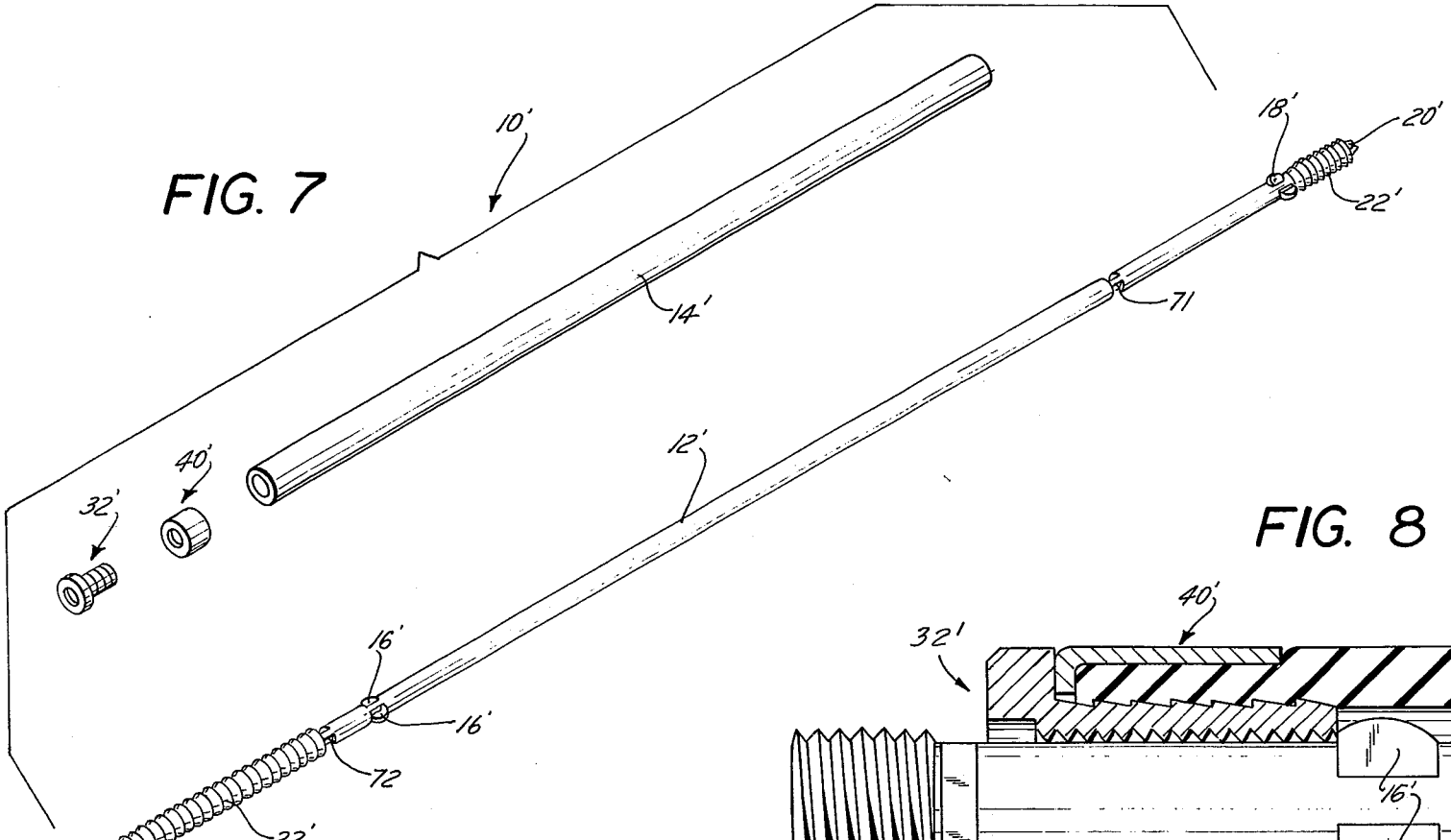
FIG. 7 is an exploded view which illustrates another form of the invention herein.
Figure 8:
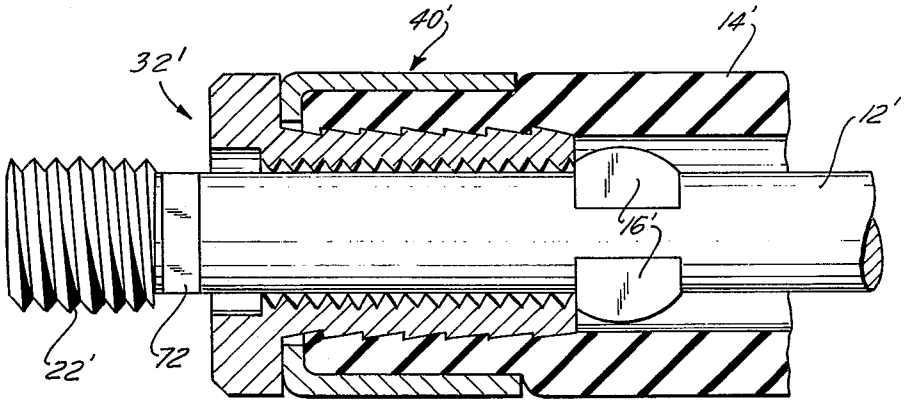
FIG. 8 is an elevational view of the tie rod and elastomeric sleeve of FIG. 7 broken away showing the end of the elastomeric sleeve and guide means mounted on the tie rod.
Figure 9:
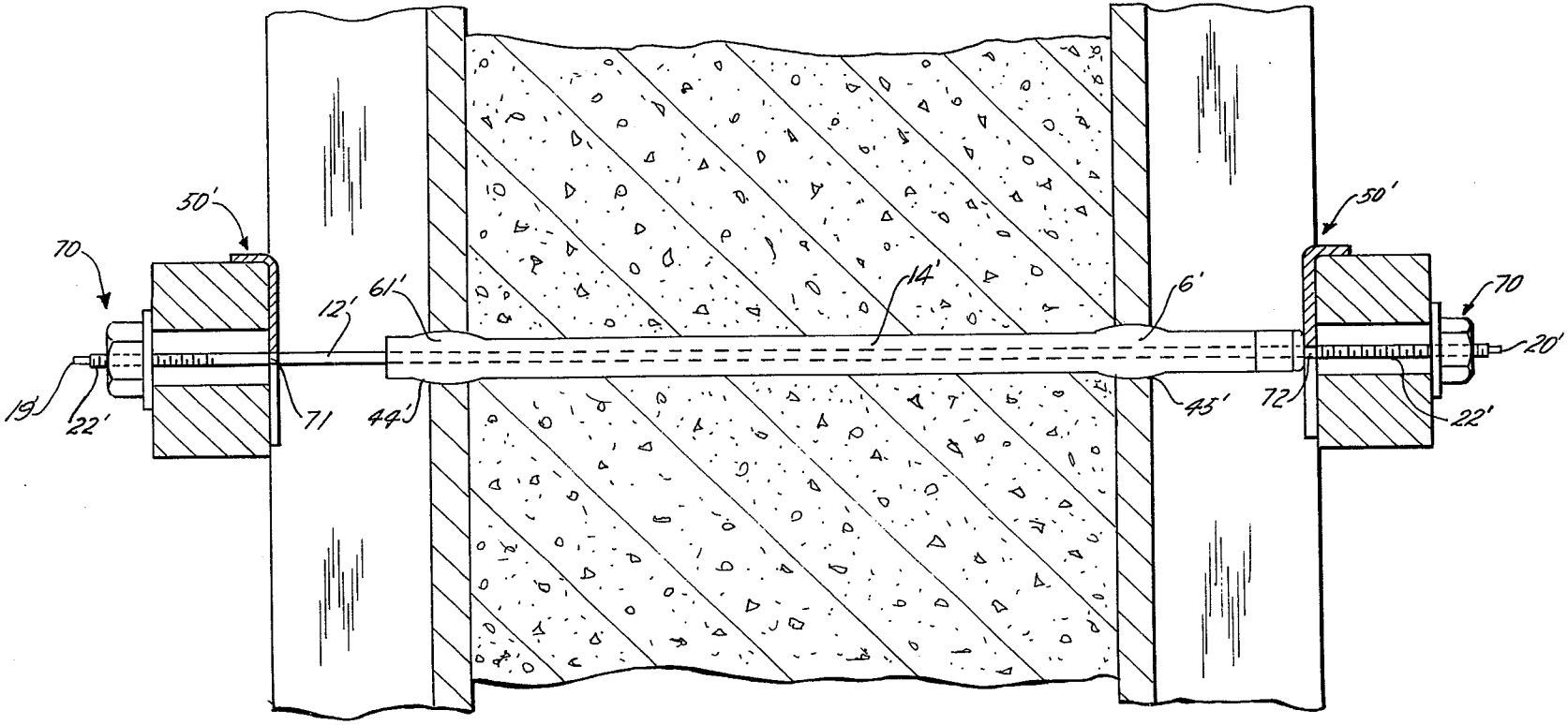
FIG. 9 is an elevational view in section of the tie assembly of FIG. 7 mounted in position on the concrete forms after the concrete has been poured between the concrete forms.

FIGS. 7 through 9 illustrate an alternate embodiment of the assembly 10 described in FIGS. 1–6. Tie assembly 10′ includes tie rod 12′, replaceable elastomeric sleeve 14′, threaded coupling 32′ and guide means 40′ which are constructed of similar materials and are arranged in a similar fashion as described in the embodiment of FIG. 1.

Tie rod 12′ is constructed generally of heavier gauge steel and is capable of withstanding greater loads than the tie assembly described in the embodiment of FIG. 6. Stops 16′ and 18′ are formed on tie rod 12′. Upset threads 22′ are formed on each end of tie rod 12′ to facilitate mounting sleeve 14′ thereon and also for mounting threaded clamp or bracket 70 for mounting tie assembly 10′ on forms F as illustrated in FIG. 9. Ends 19′ and 20′ of tie rod 12′ are formed having generally rectangular projections extending from upset threads 22′ (see FIG. 7) to facilitate coupling a wrench to tie rod 12′ for tightening or loosening threaded clamp 70 to the forms and also to facilitate removal of tie assembly 10′ by hammering thereon without destroying upset threads 22′. Spreader bracket 50′ is mounted in a similar fashion as described in the embodiment of FIG. 1. Slots 71 and 72 are formed on tie rod 12′ for receiving the slotted longitudinal leg portion of spreader bracket 50′ to prevent longitudinal displacement of tie rod 12′ when mounted in position as seen in FIG. 9. One or more other slots (not shown) may be provided outwardly from slot 72 and in the region of threads 22′ to permit the forms to be spaced further apart. In addition, where the loads are not that severe or where other spreader means may be present, the external spreader ability of this tie assembly need not be employed. This multi-positioning of the external spreader system may be incorporated in the embodiment of FIGS. 1–6 together with the use of upset threads at the tie rod ends to receive wing nuts or threaded brackets in lieu of wedges.

FIG. 8 illustrates elastomeric sleeve 14′ mounted on rod 12′ by threading the sleeve over upset threads 22′ with threaded coupling 32′. Upset threads 22′ terminate from stop 16′ a distance slightly greater than the length of threaded coupling 32′ so that when the elastomeric sleeve is mounted on tie rod 12′ the sleeve is free to rotate between the end of upset threads 22′ and stop 16′. When mounting tie assembly 10′ on forms F the same procedure is followed as set forth in FIGS. 3, 4, 5 and 6. The other end of tie rod 12′ is provided with upset threads 22′ and stop 18′ to prevent threaded coupling 70 to pass beyond stop 18′ when mounting tie rod 12′ to forms F. Spreader brackets 50′ are disposed in slots 71 and 72 to maintain the spaced distance of the forms during concrete pouring.

As described in the embodiment of FIG. 1, elastomeric sleeve 14′ is deformed under pressure of freshly poured concrete and forms a bubble 61′, 62′ which seals the openings 44′ and 45′ in forms F. When removing tie assembly 10′ from forms F, threaded couplings 70 are unthreaded from ends of tie rod 12′. The spreader brackets are removed as previously described in the embodiment of FIG. 1. Tie assembly 10′ is removed from the formed concrete structure of FIG. 9 by pushing or pulling tie assembly 10′ through the formed concrete structure in a direction along the arrows of FIG. 5 so that guide means 40′ mounted on the elastomeric sleeve 14′ is removed first.

Since the tie assembly is completely removed from the concrete structure discoloration of the concrete around the tie hole is obviated, the formed hole is neat, clean and sharp and is easily grouted. In this connection, the sleeves do not require any lubricant such as oil or grease to facilitate its removal. Accordingly the surface of the hole formed by the sleeves are not coated with oil or grease thereby allowing the grout used to close the hole to achieve a maximum bond with the surfaces of the hole to form a water-tight seal. This is important where structures holding liquids or where the concrete and structure is a foundation in ground containing water. Furthermore, capillarity is of no concern inasmuch as no part of the tie assembly remained in the hole in the concrete.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

We claim:

1. The combination of a feed-through tie assembly and concrete forms, the feed-through tie assembly for mounting as a unit on the concrete forms and for removal therefrom as a unit without first disassembling the forms or the tie assembly and without requiring a lubricant thereon, said combination comprising:

opposed concrete forms spaced a selected distance apart;

an elongated tie rod having means disposed at each end thereof for cooperating in releasably mounting the tie rod in fixed position on the forms;

means associated with the tie rod between the ends thereof for mounting external spreader means to releasably hold the concrete forms a predetermined distance apart;

an elongatable, elastomeric sleeve positioned between the ends of the tie rod and being of a length greater than the selected distance between the forms, said elongatable, elastomeric sleeve when positioned through opposed openings in the forms being self sealing due to the lateral deformation and bubbling of the sleeve when it is in the openings by the compressive forces exerted by the concrete on the tie assembly thereby plugging the openings to provide a self sealing removable closure by the elastomeric sleeve;

said sleeve and tie rod having interengageable surfaces for coupling the sleeve to the tie rod; and guide means positioned over one end of the sleeve to facilitate insertion of the tie assembly through opposed spaced openings in the forms so that both ends of the sleeve are projected exteriorly of the space between the forms.

2. The combination of claim 1 further including an external spreader means comprising an external spreader bracket for removably mounting to the concrete forms and having a longitudinally extending slot for engagement with the means associated with the tie rod between the ends thereof to maintain the concrete forms a predetermined distance apart.

3. The combination of claim 1 wherein the guide means includes a deformable tubular member rigidly mounted over one end of the elastomeric sleeve to facilitate passage of the tie assembly through the form openings.

4. The combination of claim 1 wherein the interengageable surface for releasably coupling the sleeve to the tie rod includes a threaded coupling mounted at one end of the sleeve which is held in fixed position by said guide means and the tie rod having a complementary threaded portion for threaded engagement of said coupling with said tie rod.

5. The combination of claim 4 wherein the threaded portion of the tie rod is formed having upset threads so that the threaded coupling is capable of sliding freely over the unthreaded portions of the tie rod to facilitate assembly and disassembly of the elastomeric sleeve from the tie rod.

6. The combination of claim 1 wherein the tie rod is formed having a coupling means disposed at each end of the tie rod and adapted to receive removable anchor means for rigidly mounting the tie assembly to the concrete forms.

7. The combination of claim 1 wherein the tie rod is formed having threaded end portions at each end thereof; stop means formed on said tie rod and spaced from one of said threaded portions to provide an area for receiving said elastomeric sleeve so that the sleeve is locked between the stop means and said one of said threaded portions whereby the tie rod can be rotated relative to the sleeve.

8. A concrete forming system comprising:

opposed concrete forms spaced a predetermined distance apart;

an elongated tie rod having means disposed at each end thereof for releasably mounting the tie rod in fixed position on the concrete forms;

means associated with the tie rod between the ends thereof and an external spreader means mounted thereon to releasably hold the concrete forms a predetermined distance apart;

an elongatable, elastomeric sleeve not requiring a lubricant thereon positioned between the ends of the tie rod and being of a length greater than the distance between the forms;

said sleeve and tie rod having interengageable surfaces for releasably coupling the sleeve to the tie rod in order that it may be replaced by another of said sleeves and including a guide means positioned over one end of the sleeve to facilitate insertion of the tie assembly through opposed spaced openings in the forms so that both ends of the sleeve are projected exteriorly of the space between the forms whereby the openings are sealed by the elastomeric sleeve due to the lateral deformation of the sleeve when in the openings by the compressive forces exerted by the concrete on the tie assembly to provide a self sealing removable closure by the elastomeric sleeve, and the tie rod having coupling means disposed adjacent each end thereof for releasably mounting the tie rod to the concrete forms and anchor means removably mounted on the concrete forms so as to maintain the forms in fixed position.

9. The combination of a feed-through, self sealing tie assembly and concrete forms, the feed-through, self sealing tie combination for mounting as a unit on the concrete forms and capable of being removed therefrom without first disassembling the forms or the tie assembly and without requiring a lubricant thereon, said assembly comprising:

opposed concrete forms spaced a selected distance apart;

an elongated tie rod having means disposed at each end thereof for releasably mounting the tie rod in fixed position on the concrete forms;

means associated with the tie rod between the ends thereof for mounting an external spreader means to releasably hold the concrete forms a predetermined distance apart;

an elongatable, elastomeric sleeve positioned between the ends of the tie rod and being of a length greater than the selected distance between the forms;

said sleeve and tie rod having interengageable surfaces for releasably coupling the sleeve to the tie rod in order that it may be replaced by another of said sleeves and including a guide means positioned over one end of the sleeve to facilitate insertion of the tie assembly through opposed spaced openings in the forms so that both ends of the sleeve are projected exteriorly of the space between the forms whereby the openings are sealed by the elastomeric sleeve due to the lateral deformation of the sleeve when in the openings by the compressive forces exerted by the concrete on the tie assembly to provide a self sealing removable closure by the elastomeric sleeve.

10. The combination of a feed-through tie assembly and concrete forms, the feed-through tie assembly for mounting as a unit on the concrete forms and for removal therefrom as a unit without first disassembling the forms or the tie assembly and without requiring a lubricant thereon, said combination comprising:

opposed concrete forms spaced a selected distance apart;

an elongated tie rod having means disposed at each end thereof for cooperating in releasably mounting the tie rod in fixed position of the forms;

an elongatable, replaceable elastomeric sleeve positioned between the ends of the tie rod and being of a length greater than the selected distance between the forms;

said sleeve and tie rod having interengageable surface for coupling the sleeve to the tie rod for facilitating the replacement of the sleeve when worn or damaged, said elongatable elastomeric sleeve when positioned through opposed openings in the forms being self sealing due to the lateral deformation and bubbling of the sleeve when it is in the openings by the compressive forces exerted by the concrete on the tie assembly thereby plugging the openings to provide a self sealing removable closure by the elastomeric sleeve; and guide means positioned over one end of the sleeve to facilitate insertion of the tie assembly through opposed spaced openings in the forms so that both ends of the sleeve are projected exteriorly of the space between the forms.

11. The invention in accordance with claim 10 wherein the interengageable surface for releasably coupling the sleeve to the tie rod includes mating threads on a threaded coupling associated with the guide means affixed to said one end of the sleeve and upset threads on the tie rod intermediate the ends of the rod.

12. The invention in accordance with claim 11 wherein external spreader means are associated with the tie rod between the ends thereof for cooperating with external spreader brackets to releasably hold the concrete forms a predetermined distance apart.

13. The invention in accordance with claim 12 wherein the mating threads are disposed intermediate the external spreader means.

14. The invention in accordance with claim 13 wherein the upset threads on the tie rod are disposed outwardly from the external spreader means.

15. The invention in accordance with claim 12 wherein the external spreader means includes slots in the tie rod for cooperating and receiving external spreader brackets.

16. The invention in accordance with claim 10 wherein the means disposed at each end of the tie rod for releasably mounting the tie rod in fixed position on the forms includes slots for cooperating in receiving wedges.

17. The invention in accordance with claim 10 wherein the means disposed at each end of the tie rod for cooperating in mounting the tie rod in fixed position on the forms includes upset threads for receiving threaded means for anchoring the tie assembly to the forms.

18. A feed-through tie assembly for mounting as a unit on concrete forms and for removal therefrom as a unit without first disassembling the forms or the tie assembly and without requiring a lubricant thereon, said assembly comprising:

an elongated tie rod having means disposed at each end thereof for cooperating in releasably mounting the tie rod in fixed position on the forms;

means associated with the tie rod between the ends thereof for mounting external spreader means to releasably hold the concrete forms a predetermined distance apart;

an elongatable, elastomeric sleeve positioned between the ends of the tie rod;

guide means positioned over one end of the sleeve to facilitate insertion of the tie assembly through opposed spaced openings in the forms; and said sleeve and tie rod having interengageable surfaces for releasably coupling the sleeve to the tie rod, the interengageable surfaces for releasably coupling the sleeve to the tie rod including a threaded coupling mounted at one end of the sleeve which is held in fixed position by said guide means and the tie rod having a complementary threaded portion for threaded engagement of said coupling with said tie rod.

19. The tie assembly of claim 18, wherein the threaded portion of the tie rod is formed having upset threads so that the threaded coupling is capable of sliding freely over the unthreaded portions of the tie rod to facilitate assembly and disassembly of the elastomeric sleeve from the tie rod.

20. A feed through tie assembly for mounting as a unit on concrete forms and for removal therefrom as a unit without first disassembling the forms or the tie assembly and without requiring a lubricant thereon, said assembly comprising;

an elongated tie rod having means disposed at each end thereof for cooperating in releasably mounting the tie rod in fixed position on the forms;

an elongatable, replaceable elastomeric sleeve positioned between the ends of the tie rod;

guide means positioned over one end of the sleeve to facilitate insertion of the tie assembly through opposed spaced openings in the forms so that both ends of the sleeve are projected exteriorly of the forms; and said sleeve and tie rod having interengageable surfaces for releasably coupling the sleeve to the tie rod for facilitating the replacement of the sleeve when worn or damaged, the interengageable surfaces for releasably coupling the sleeve to the tie rod including mating threads on a threaded coupling associated with the guide means affixed to said one end of the sleeve and upset threads on the tie rod intermediate the ends of the rod.

21. The invention in accordance with claim 20, wherein external spreader means are associated with the tie rod between the ends thereof for cooperating with external spreader brackets to releasably hold the concrete forms a predetermined distance apart.

22. The invention in accordance with claim 21, wherein the mating threads are disposed intermediate the external spreader means.

23. The invention in accordance with claim 22, wherein the upset threads on the tie rod disposed outwardly from the external spreader.

24. The invention in accordance with claim 21, wherein the external spreader means includes slots in the tie rod for cooperating and receiving external spreader brackets.

25. The combination of a feed-through tie assembly and concrete forms, the feed-through tie assembly for mounting as a unit on the concrete forms and for removal therefrom as a unit without first disassembling the forms or the tie assembly and without requiring a lubricant thereon, said combination comprising:

opposed concrete forms spaced a selected distance apart;

an elongated tie rod having means disposed at each end thereof for cooperating in releasably mounting the tie rod in fixed position on the forms;

spreader means for associated with the forms for holding the concrete forms a predetermined distance apart;

an elongatable, elastomeric sleeve positioned between the ends of the tie rod and being of a length greater than the selected distance between the forms, said elongatable elastomeric sleeve when positioned through opposed openings in the forms being self sealing due to the lateral deformation and bubbling of the sleeve when it is in the openings by the compressive forces exerted by the concrete on the tie assembly thereby plugging the openings to provide a self sealing removable closure by the elastomeric sleeve;

said sleeve and tie rod having interengageable surfaces for coupling the sleeve to the tie rod; and guide means positioned over one end of the sleeve to facilitate insertion of the tie assembly through opposed spaced openings in the forms so that both ends of the sleeve are projected exteriorly of the space between the forms.

* * * * *

UNITED STATES PATENT OFFICE
CERTIFICATE OF CORRECTION

PATENT NO. : 3,933,332

DATED : January 20, 1976

INVENTOR(S) : Peter R. Lovisa and Dusan Tausanovitch

It is certified that error appears in the above-identified patent and that said Letters Patent are hereby corrected as shown below:

olumn 1, line 35, "integral" should be --internal--;

olumn 8, line 9, "combination" should be --assembly--;

olumn 8, line 13, "assembly" should be --combination--;

olumn 10, line 34, after "rod" insert --are--;

olumn 10, line 51, delete "for" in the first instance.

Signed and Sealed this

*twenty-fifth* Day of *May 1976*

[SEAL]

*Attest:*

RUTH C. MASON
*Attesting Officer*

C. MARSHALL DANN
*Commissioner of Patents and Trademarks*